US012398611B2

(12) United States Patent
Quero

(10) Patent No.: US 12,398,611 B2
(45) Date of Patent: Aug. 26, 2025

(54) WELL ABANDONMENT AND SEVERANCE OF CONTROL LINES

(71) Applicant: Halliburton Energy Services, Inc., Houston, TX (US)

(72) Inventor: Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/115,591

(22) Filed: Feb. 28, 2023

(65) Prior Publication Data

US 2024/0287864 A1 Aug. 29, 2024

(51) Int. Cl.
*E21B 33/05* (2006.01)
*E21B 33/12* (2006.01)

(52) U.S. Cl.
CPC ..... *E21B 33/05* (2013.01); *E21B 33/1208* (2013.01)

(58) Field of Classification Search
CPC ..... E21B 33/05; E21B 33/1208
See application file for complete search history.

(56) References Cited

U.S. PATENT DOCUMENTS

| | | | | |
|---|---|---|---|---|
| 9,562,395 | B2 * | 2/2017 | Grubb | E21B 7/14 |
| 11,280,155 | B2 | 3/2022 | Quero et al. | |
| 11,299,938 | B2 | 4/2022 | Quero et al. | |
| 11,512,574 | B1 | 11/2022 | Quero | |
| 11,530,579 | B2 | 12/2022 | Sahdev et al. | |
| 11,542,777 | B2 | 1/2023 | Quero et al. | |
| 2012/0006547 | A1 | 1/2012 | Robertson et al. | |
| 2012/0074110 | A1 * | 3/2012 | Zediker | E21B 10/60 219/121.72 |
| 2012/0305679 | A1 | 12/2012 | Surjaatmadja et al. | |
| 2016/0010415 | A1 | 1/2016 | Myhre et al. | |
| 2020/0392802 | A1 * | 12/2020 | Quero | E21B 33/14 |
| 2021/0010337 | A1 | 1/2021 | Sahdev et al. | |
| 2021/0079748 | A1 | 3/2021 | Wardley et al. | |
| 2021/0131276 | A1 | 5/2021 | Leblanc et al. | |
| 2021/0162545 | A1 * | 6/2021 | Faircloth | B23K 26/1476 |

FOREIGN PATENT DOCUMENTS

| | | | |
|---|---|---|---|
| WO | 2020076163 | A1 | 4/2020 |
| WO | 2022171604 | A1 | 8/2022 |

OTHER PUBLICATIONS

International Search Report and Written Opinion for International Patent Application No. PCT/US2023/015823 dated Nov. 15, 2023. PDF file. 9 pages.

* cited by examiner

*Primary Examiner* — Silvana C Runyan
(74) *Attorney, Agent, or Firm* — Thomas Rooney; C. Tumey Law Group PLLC

(57) ABSTRACT

A method may include injecting a sealing material into an annulus formed between a tubular and a wellbore wall. The sealing material is configured to surround at least a portion of a control line disposed in the annulus. Further, the method includes making at least one orbital cut, via a cutting device, through the tubular, the sealing material in the annulus, and the control line surrounded by the sealing material. Additionally, the method includes filling the at least one orbital cut and at least a portion of a central bore of the tubular with additional sealing material to seal the wellbore.

10 Claims, 7 Drawing Sheets

WELL ABANDONMENT AND SEVERANCE OF CONTROL LINES

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. Further, cement may be pumped into the annular space between the casing and a wellbore wall to form a seal. To access the hydrocarbons for production, a perforating gun system may be deployed into the casing string to form perforations in the casing and/or cement such that hydrocarbons may flow into the casing string via the perforation. Further, tubing may be lowered into the well as part of production to provide a reduced diameter fluid path for the hydrocarbons during production. Once production operations have concluded, plug and abandonment (P&A) operations may be conducted. P&A operations generally include severing control lines and/or flat packs to reduce sealing issues for the wellbore. Non-severed control lines may provide leak paths for hydrocarbons to travel through a cement seal formed in the wellbore as part of the P&A operations.

Generally, during P&A operations, a cutting tool is lowered into the wellbore to cut the control lines prior to pumping cement into the wellbore since the control lines are generally accessible at this stage. In particular, the cutting tool is lowered to a desired depth in the tubing where the cutting tool is deployed to cut through the tubing and the control lines at the desired depth. However, control lines may float in the annulus between the tubing and the casing. As such, the control lines may move in response to contact with the cutting tool, which may result in the cutting tool failing to successfully sever the control lines. Unfortunately, as set forth above, failing to sever the control lines may result in leak paths extending through the cement, which may compromise the seal formed by the P&A operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for severing control lines and/or flat packs during plug and abandonment (P&A) operations and, more particularly, example embodiments may include injecting a sealing material such as cement into an annulus formed between a wellbore wall of the wellbore and a tubular disposed in the wellbore. The control lines and/or flat packs may be disposed in the annulus. As set forth in greater detail below, the sealing material may be configured to restrain movement of the control lines and/or flat packs such that an orbital cut from a cutting device may reliably sever the control lines and/or flat packs.

Figure 1:
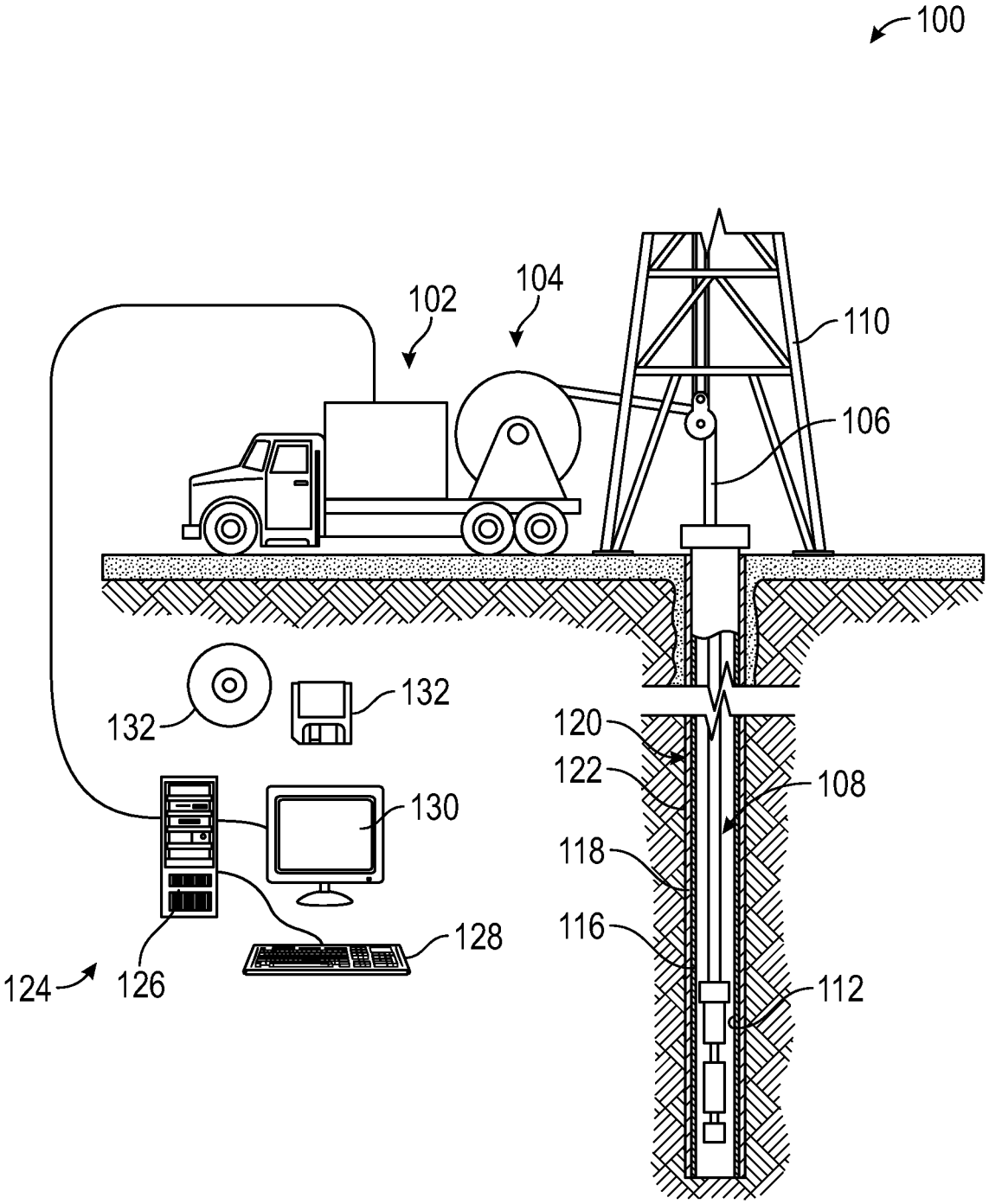
FIG. 1 illustrates an elevation view of a well system, in accordance with some embodiments of the present disclosure.

FIG. 1 illustrates an elevation view of a well system, in accordance with some embodiments of the present disclosure. It should be noted that while FIG. 1 generally depicts a land-based operations, those skilled in the art will readily recognize that the principles described herein are equally applicable to subsea operations that employ floating or sea-based platforms and rigs, without departing from the scope of the disclosure. As illustrated, a well abandonment system 100 may comprise a vehicle 102 (e.g., mounted truck coiled tubing unit) or any suitable surface system 104 for raising and lowering coiled tubing 106 in a wellbore 108. Generally, the wellbore 108 may be lined with casing 116, and cement 118 may be pumped into an outer annulus 120 between the casing 116 and a wellbore wall 122 to protect the wellbore 108 from failure (e.g., collapse, erosion) and to provide a fluid path for hydrocarbons during production. Although the illustrated embodiment shows a drilling rig 110 supporting the coiled tubing 106, the vehicle 102 may be configured to run the coiled tubing 106 without a drilling rig 110. Alternatively, the vehicle and/or the drilling rig may be configured to run any suitable conveyance (e.g., slickline, wireline, drill pipe, etc.) into the wellbore. As set forth in greater detail below, the well system may lower various downhole tools 112 (e.g., perforating guns, cutting devices, milling devices, etc.) via a corresponding conveyance.

Moreover, during plug and abandonment operations, the well abandonment system 100 may relay information between the surface and the downhole tools 112. In particular, the well abandonment system 100 may further include an information handling system 124 configured to process information gathered by the downhole tools 112. For example, sensor data recorded by downhole tools 112 may be communicated to and then processed by information handling system 124. Without limitation, the processing may be performed in real-time. Processing may alternatively occur downhole or may occur both downhole and at the surface. The sensor data recorded by downhole tools 112 may be conducted to information handling system 124 via coiled tubing 106 or any suitable transmission medium. Information handling system 124 may process the signals, and the information contained therein may be displayed for an operator to observe and stored for future processing and reference. Information handling system 124 may also contain an apparatus for supplying control signals to the downhole tools 112.

Information handling system 124 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 124 may be a processing unit 126, a network storage device, or any other suitable device and may vary in size, shape, performance, functionality, and price. Information handling system 124 may include random access memory (RAM), one or more processing resources such as a central processing unit (CPU) or hardware or software control logic, ROM, and/or other types of nonvolatile memory. Additional components of the information handling system 124 may include one or more disk drives, one or more network ports for communication with external devices as well as various input and output (I/O) devices, such as an input device 128 (e.g., keyboard, mouse, etc.) and a display 130. Information handling system 124 may also include one or more buses operable to transmit communications between the various hardware components.

Alternatively, systems and methods of the present disclosure may be implemented, at least in part, with non-transitory computer-readable media 132. Non-transitory computer-readable media 132 may include any instrumentality or aggregation of instrumentalities that may retain data and/or instructions for a period of time. Non-transitory computer-readable media 132 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

FIGS. 2A-2F illustrate respective cross-sectional views of the well abandonment system 100 configured to sever control lines 200 in the wellbore 108, in accordance with some embodiments of the present disclosure. In particular, FIG. 2A discloses the wellbore 108 having a plug 202 disposed in an inner tubular 204 (e.g., production tubing) to form a fluid barrier. That is, the plug 202 may be run-in-hole and set at a target location in the inner tubular 204 to block fluid from traveling through the inner tubular 204. The plug 202 may include any suitable material. In the illustrated embodiment, the plug comprises a cylindrical shape such that a radially outer surface 206 of the plug 202 may seal against a radially inner surface 208 of the inner tubular 204 to restrain fluid. However, the plug may include any suitable shape for blocking fluid. Further, the plug 202 may be expandable. That is, the plug 202 may be run-in-hole to the target location and then expand at the target location to seal against the inner tubular 204.

The plug 202 may be run-in-hole via a conveyance (e.g., plug conveyance 210) to the target location (e.g., a predetermined sealing position in in the wellbore 108). Sealing positions (e.g., position for sealing the wellbore during plug and abandonment operations) may be predetermined based at least in part on local regulations, common practice, or other suitable guidance. For example, local regulations may require that a wellbore be sealed between production zones and usable water strata. As such, prior to plug and abandonment operations, a sealing position between a production zone and usable water strata may be predetermined. Moreover, in the illustrated embodiment, the plug conveyance 210 includes a slickline configured to lower the plug 202 into the wellbore 108. However, the plug conveyance 210 may include any suitable conveyance, such as a wireline, coiled tubing, drill pipe, or some combination thereof, for running the plug 202 into the wellbore 108.

Moreover, the wellbore 108 may be formed with various tubulars (e.g., production tubing 212, production casing 214, intermediate casing, surface casing 216, conductor casing 218, etc.). In the illustrated embodiment, the conductor casing 218 is the radially outermost tubular disposed in the wellbore 108. The surface casing 216 may be disposed within the conductor casing 218 (e.g., disposed radially inward from the conductor casing 218), and the production casing 214 may be disposed within the surface casing 216. Further, the inner tubular 204 (e.g., production tubing 212) is disposed within the production casing 214. However, the wellbore 108 may include any suitable structure. For example, the wellbore 108 may include at least one intermediate casing disposed between the surface casing 216 and the production casing 214. During installation of the tubulars, cement 118 may be disposed at least between the conductor casing 218 and the wellbore wall 122, between the surface casing 216 and the conductor casing 218, and between the production casing 214 and the surface casing 216. However, an annulus 220 formed between the inner tubular 204 and the production casing 214 may be left open such that fluid may flow through the annulus 220. In the illustrated embodiment, the annulus 220 may be sealed via a packer assembly 222 or any suitable sealing feature to restrain fluid flow from a bottom of the wellbore 108 to the surface. However, some wellbores 108 may not include the packer assembly 222. Further, as illustrated, the plug 202 may be run-in-hole to a location disposed proximate the packer assembly 222. The packer assembly 222 and the plug 202, in combination, may provide a fluid barrier between the surface and a bottom of the wellbore 108 and/or a production zone.

Figures 2A, 2B, 2C:
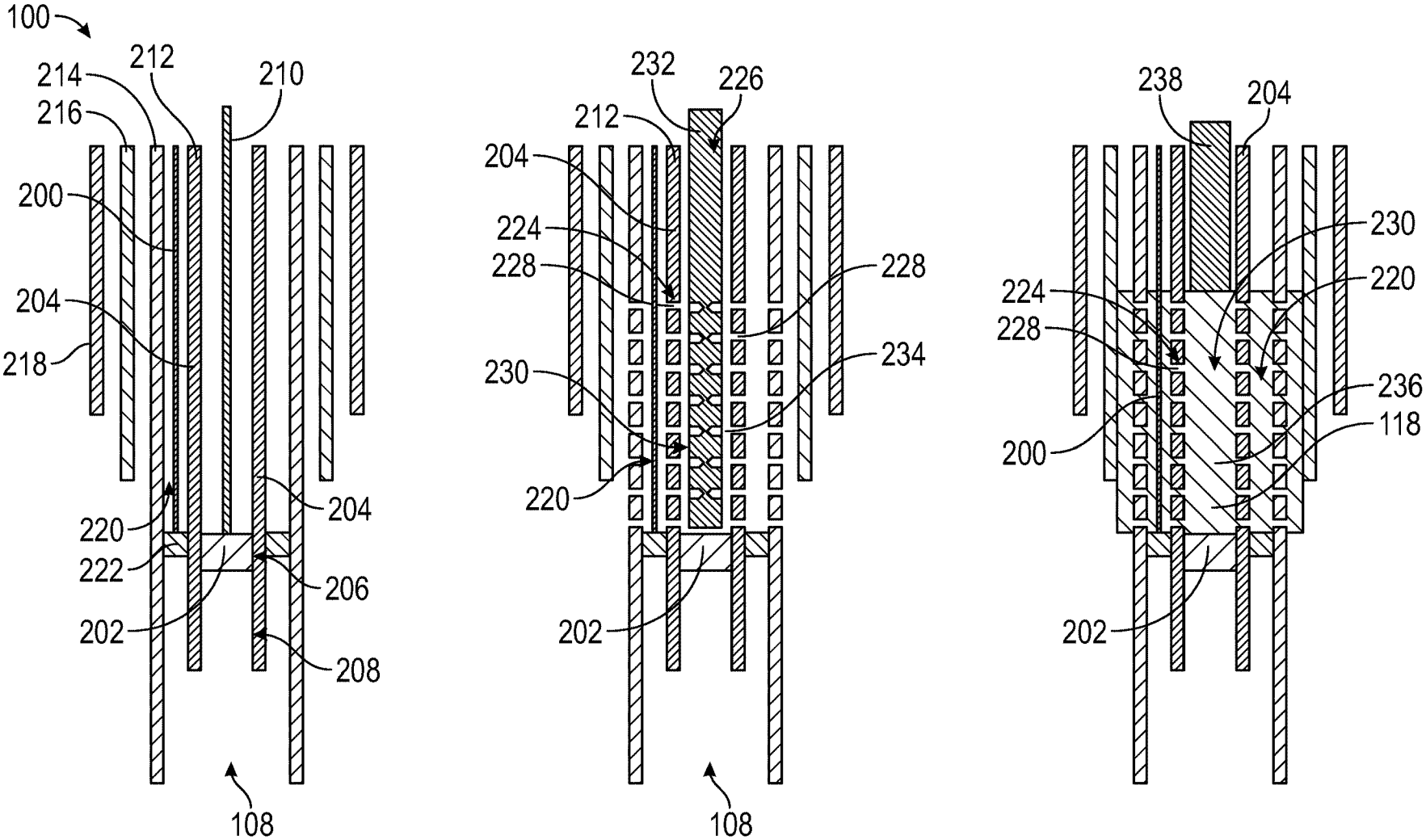
FIGS. 2A-2F illustrate respective cross-sectional views of a well abandonment system configured to sever control lines in a wellbore, in accordance with some embodiments of the present disclosure.

FIG. 2B discloses the inner tubular 204 having a plurality of perforations 224. With the plug 202 set in the inner tubular 204 (e.g., the production tubing), a perforating device 226 may be lowered into the wellbore 108 to perforate the inner tubular 204 at a position above the plug 202. Perforating the inner tubular 204 above the plug 202 may open at least one fluid path 228 between a central bore 230 of the inner tubular 204 and the annulus 220. As set forth above, the annulus 220 may be formed between the inner tubular 204 and the production casing 214 or wellbore wall 122. As set forth in greater detail below, the at least one fluid path 228 may fluidly connect the central bore 230 to the annulus 220 at a location proximate the plug 202 such that sealing material 236 (shown in FIG. 2C) may be injected into the annulus 220 from the central bore 230.

Moreover, the perforating device 226 may include a perforating gun 232 having shaped charges 234 configured to detonate in a substantially radially outward direction to perforate the inner tubular 204 above the plug 202 disposed in the wellbore 108. In the illustrated embodiment, both the inner tubular 204 (e.g., production tubing 212) and the production casing 214 have been perforated by the perforating device 226. For example, a blast from the shaped charges 234 may perforate the inner tubular 204, the production casing 214, and continue through the wellbore wall 122 into a downhole formation. Alternatively, the perforating device 226 may be configured to only perforate the inner tubular 204. For example, the perforating device 226 may comprise a cutting device 246 (e.g., blade, reamer, hydro jet, plasma torch, etc.) shown in FIG. 2E. The cutting device 246 is configured to make at least one orbital cut to perforate the inner tubular 204 (e.g., production tubing) above the plug 202 disposed in the wellbore 108. However, the cutting device 246 may be configured to also perforate the production casing 214 and/or the wellbore wall 122.

Moreover, as illustrated, the perforating device 226 may be configured to make a plurality of perforations to open a plurality of fluid paths 228 between the central bore 230 and the annulus 220. For example, the perforating device 226 may comprise a perforating gun 232 having a dozen shaped charges 234. In response to detonation of the shaped charges 234, the inner tubular 204 may be perforated with a dozen corresponding perforations 224 that each form a respective fluid path 228 between the central bore 230 and the annulus 220. As set forth in greater detail below, having a plurality of fluid paths 228 may help increase a flow rate of fluid (e.g., the sealing material 236 shown in FIG. 2C) between the central bore 230 and the annulus 220. The perforating device 226 may be configured to form perforations 224 in the inner tubular 204 with any suitable spacing, sizing, and number, to provide a desired flow area between the central bore 230 and the annulus 220.

FIG. 2C discloses the sealing material 236 disposed in the annulus 220 and the central bore 230 of the inner tubular 204. With the inner tubular 204 perforated above the plug 202, the sealing material 236 may be injected into the wellbore 108. In particular, an injection conveyance 238 (e.g., coiled tubing, drill pipe, etc.) may be lowered into the inner tubular 204 to a position proximate the plug 202 and/or the at least one perforation 224 in the inner tubular 204. The sealing material 236 may be delivered in an at least partially liquid state to the central bore 230. As such, the sealing material 236 may flow downhole toward the plug 202 and flow radially outward into the annulus 220 via the at least one fluid path 228. As such, the sealing material 236 may be injected into the annulus 220 formed between the inner tubular 204 (e.g., production tubing) and the production casing 214 and/or the wellbore wall 122. The sealing material 236 is configured to surround at least a portion of the control line 200 and/or flat pack disposed in the annulus 220.

Further, the sealing material 236 may include cement, plastic, resin, or some combination thereof. As set forth above, the sealing material 236 is injected into the annulus 220 in at least a partially liquid or fluid state. However, the sealing material 236 is configured to solidify after being injected into the annulus 220. For example, the sealing material 236 may include cement 118 that is mixed with water prior to being injected into the wellbore 108 such that the cement 118 is in a liquid or fluid state. In the fluid state, the cement 118 may flow through the injection conveyance 238 down to the central bore 230 and out through the at least one fluid path 228 into the annulus 220. Due to the chemical reaction (e.g., hydration) between the water and the cement 118, the cement 118 may solidify or harden over time. Once hardened, the cement 118 disposed in the annulus 220 may restrain movement of the control line 200. Specifically, the hardened cement 118 may restrain lateral movement of the control line 200.

Figure 2F:
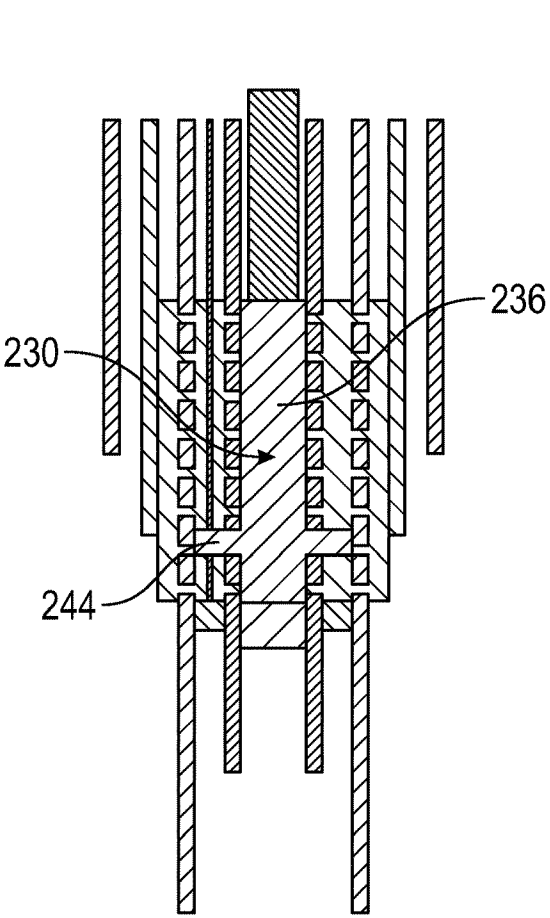
Figure 2E:
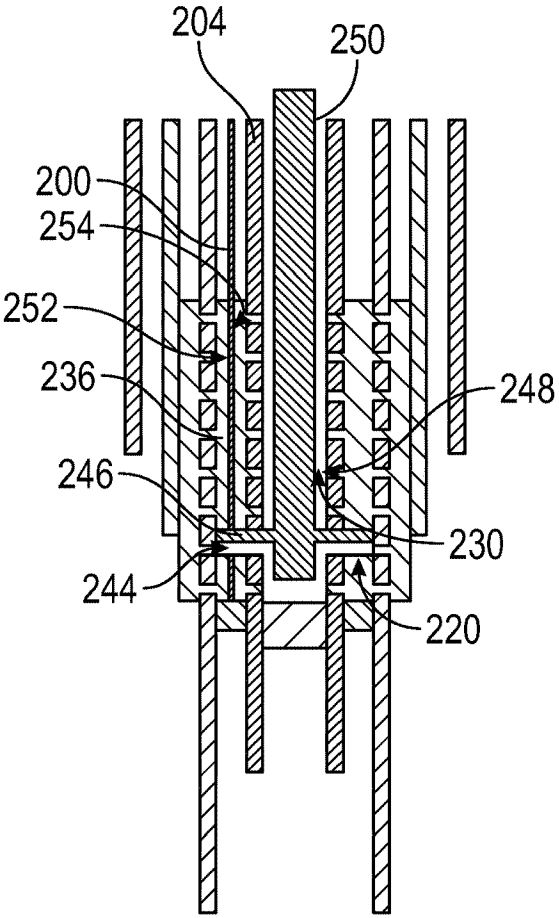
Figure 2D:
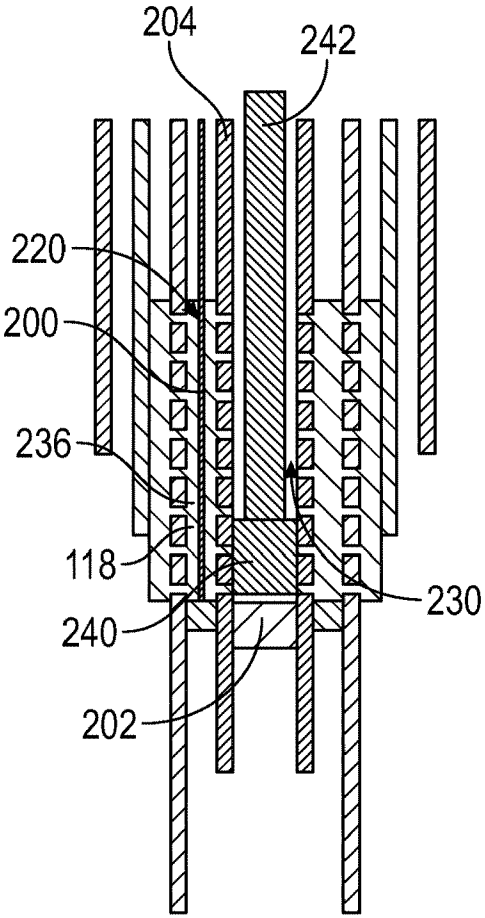

FIG. 2D discloses the sealing material 236 being milled out from the central bore 230 of the inner tubular 204. With the sealing material 236 disposed and hardened in the annulus 220, the sealing material 236 may be configured to restrain movement of the control lines 200 and/or flat packs such that making an orbital cut 244 (shown in FIG. 2E) with the cutting device 246 may reliably sever the control lines 200 and/or flat packs. However, to make the orbital cut, the cutting device 246 may need to be lowered into the inner tubular 204 to a location in the central bore 230 that is axially aligned with a portion of the annulus 220 that is filled with the sealing material 236. Unfortunately, injecting the sealing material 236 into the annulus 220 may also dispose the sealing material 236 in the central bore, and the sealing material 236 disposed in the central bore 230 may be at a same height or higher than the sealing material 236 in the annulus 220.

Thus, to lower the cutting device 246 into the inner tubular 204 to a location that is axially aligned with a portion of the annulus 220 that is filled with the sealing material 236, at least a portion the sealing material 236 in the central bore 230 may need to be removed. For example, a milling device 240 may be lowered into the central bore 230 to mill out at least a portion of the hardened cement 118 disposed in the central bore 230 above the plug 202. As illustrated, the milling device 240 may mill out the cement 118 down to a location of the plug 202. Alternatively, the milling device 240 may mill out only a portion of the cement 118 in the central bore 230. However, the milling device 240 may at least mill out a sufficient portion of the cement 118 in the central bore 230 such that the cutting device 246 may be lowered to a position in the central bore 230 that is axially aligned with a portion of the annulus 220 having the hardened cement 118 surrounding the control lines 200 and/or flat pack.

Moreover, the milling device 240 may include a drill bit (e.g., a fixed cutter drill bit, a roller cone bit, a hybrid drill bit, etc.), a reamer, or any other suitable milling device. The milling device 240 may be run-in-hole via a milling conveyance 242 (e.g., drill pipe, coiled tubing, etc.) to the hardened cement 118 in the central bore 230. With the milling device 240 in position, a mud motor (not shown) may be configured to drive rotation of the milling device 240 to engage and mill out the cement 118. Once the cement 118 in the central bore is sufficiently milled out, the milling conveyance 242 may be configured to pull the milling device 240 out-of-hole.

FIG. 2E discloses the control line 200 and/or flat pack severed via making an orbital cut 244. As illustrated, the cutting device 246 may be run-in-hole to a target location in the central bore 230 for making the at least one orbital cut 244 (e.g., a location that is axially aligned with a portion of the annulus 220 that is filled with the hardened sealing material 236). For example, the cutting device 246 may be run-in-hole to a milled out portion 248 of the central bore 230 of the inner tubular 204 to make the at least one orbital cut 244. The cutting device 246 may be run-in-hole via a cutting device conveyance 250 (e.g., a slickline, a wireline, coiled tubing, drill pipe, etc.). Further, the cutting device 246 may include any suitable cutting device. For example, the cutting device 246 may include an abrasive jetting device, a blade cutter, a reamer, a plasma torch, or some combination thereof.

Moreover, at the target location, the cutting device 246 may be configured to cut through the inner tubular 204 (e.g., production tubing) and the sealing material 236 in the annulus 220 and sever the control line 200 surrounded by the sealing material 236. Indeed, the hardened sealing material 236 is configured to restrain at least lateral movement of the control line 200. As set forth above, the cutting device 246 may fail to cut the control line 200 if the control line 200 is permitted to move in response to contact with the cutting device 246. However, in the illustrated embodiment, as the cutting device 246 cuts through the sealing material 236 and engages the control line 200 and/or flat pack, the remaining sealing material 236 may prevent the control line 200 and/or flat pack from moving laterally in response to contact with the cutting device 246. That is, the cutting device 246 may engage a radially inner side 252 of the control line 200 and a radially outer side 254 of the control line 200 may be in contact with the remaining hardened sealing material 236. As the cutting device 246 engages the radially inner side 252, the remaining hardened sealing material 236 may prevent the control line 200 from moving radially outward such that the cutting device 246 may engage and sever the control line 200. Similarly, should the cutting device 246 engage another side of the control line 200, an opposite side of the control line 200 may interface with the remaining hardened sealing material 236 to prevent the control line 200 from moving with respect to the cutting device 246.

FIG. 2F discloses the sealing material 236 (e.g., cement) disposed in the orbital cut 244 and the central bore 230. After making the orbital cut 244, additional sealing material 236 may be injected into the central bore 230 of the inner tubular 204 (e.g., production tubing) to fill the volume removed by making the orbital cut 244 and at least a portion of the central bore 230. As set forth above, the control lines 200 may provide leak paths for hydrocarbons to travel through a seal formed in the wellbore as part of the P&A operations. Accordingly, filling the orbital cut 244 with the additional sealing material 236 may fluidly isolate a lower portion 324 of the severed control line 200 from an upper portion 326 of the severed control line 200, which may block a leak path for hydrocarbons.

Figures 3A, 3B, 3C:
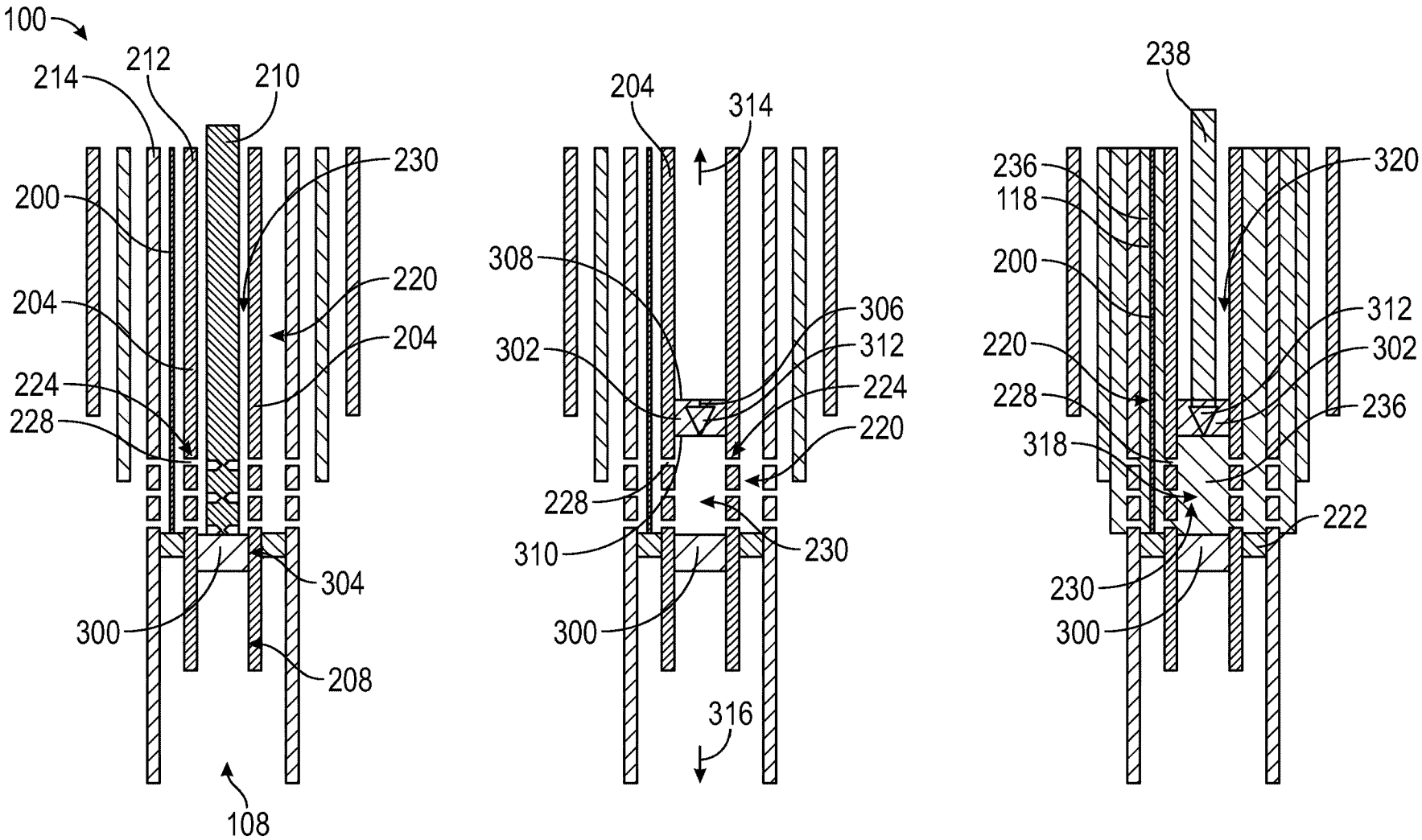
FIGS. 3A-3F illustrate respective cross-sectional views of another well abandonment system configured to sever control lines in a wellbore, in accordance with some embodiments of the present disclosure.

FIGS. 3A-3F illustrate respective cross-sectional views of another well abandonment system 100 configured to sever the control lines 200 in the wellbore 108, in accordance with some embodiments of the present disclosure. FIG. 3A discloses the wellbore 108 having a primary plug 300 disposed in an inner tubular 204 to form a fluid barrier, as well as the inner tubular 204 having a plurality of perforations 224. The primary plug 300 may be run-in-hole and set at a target location in the inner tubular 204 (e.g., the production tubing) to block fluid from traveling through the inner tubular 204 at the primary plug 300. The primary plug 300 may include any suitable material. In the illustrated embodiment, the primary plug 300 comprises a cylindrical shape such that a radially outer surface 304 of the primary plug 300 may seal against the radially inner surface 208 of the inner tubular 204 to restrain fluid. However, the primary plug 300 may include any suitable shape for blocking fluid. Further, the primary plug 300 may be expandable. That is, the primary plug 300 may be run-in-hole to the target location and then expand at the target location to seal against the inner tubular 204.

Further, the annulus 220 may be formed between the inner tubular 204 and the production casing 214 and/or the wellbore wall 122 may be left open (e.g., not filled with cement) such that fluid may flow through the annulus 220. In the illustrated embodiment, the annulus 220 may be sealed via the packer assembly 222 or any suitable sealing feature to restrain fluid flow from the bottom of the wellbore 108 to the surface. Further, as illustrated, the primary plug 300 may be run-in-hole to a location disposed proximate the packer assembly 222. The packer assembly 222 and the primary plug 300, in combination, may provide a fluid barrier between the surface and the bottom of the wellbore 108 and/or a production zone.

Moreover, with the primary plug 300 set in the inner tubular 204, the perforating device 226 (e.g., perforating gun, blade, reamer, hydro jet, plasma torch, etc.) may be lowered into the wellbore 108 to perforate the inner tubular 204 above the primary plug 300. Perforating the inner tubular 204 above the primary plug 300 may open the at least one fluid path 228 between the central bore 230 of the inner tubular 204 and the annulus 220. As set forth above, the annulus 220 may be formed between the inner tubular 204 and the production casing 214 and/or the wellbore wall 122. The at least one fluid path 228 may fluidly connect the central bore 230 to the annulus 220 at a location proximate the primary plug 300 such that the sealing material 236 may be injected into the annulus 220 from the central bore 230. In the illustrated embodiment, the inner tubular 204 has a plurality of perforations 224 such that a plurality of fluid paths 228 extend between the central bore 230 and the annulus 220.

FIG. 3B discloses a secondary plug 302 disposed in the inner tubular 204. As illustrated, the secondary plug 302 may be run-in-hole and set in a position uphole from both the primary plug 300 and the plurality of perforations 224 (e.g., the plurality of fluid paths 228 extending between the central bore 230 and the annulus 220). Moreover, the secondary plug 302 may comprise a through bore 306 extending from an uphole end 308 to a downhole end 310 of the secondary plug 302 such that fluid may pass through the secondary plug 302. However, the secondary plug 302 may also include a check-valve 312 configured to restrain fluid flow in the uphole direction 314. The check-valve 312 may include any suitable type of check valve for restraining flow of the sealing material 236 in the uphole direction 314 and permitting fluid flow of the sealing material 236 in a downhole direction 316 through the check-valve 312. For example, the check-valve 312 may include a flapper check valve having a flapper (not shown) configured to swing open in response to fluid (e.g., the sealing material 236) flowing in the downhole direction 316 and close in response to the fluid flowing in the uphole direction 314. Alternatively, a closing sleeve (not shown) may be disposed in the secondary plug 302 to restrain fluid flow in the uphole direction 314 while permitting fluid flow in the downhole direction 316. That is, the closing sleeve may open in response to the injection conveyance 238 stinging into the closing sleeve. With the closing sleeve connected to the injection conveyance 238, downhole flow of the sealing material into the closing sleeve from the injection conveyance 238 may block fluid flowing in the uphole direction 314. Further, in response to the injection conveyance 238 disconnecting (e.g., sting out) the closing sleeve is configured to close to block fluid flow in the uphole direction 314. However, any suitable device may be used to restrain fluid flow in the uphole direction 314 while permitting fluid flow in the downhole direction 316 through the secondary plug 302.

FIG. 3C discloses the sealing material 236 disposed in the annulus 220 and a portion of the central bore 230 disposed between the primary plug 300 and the secondary plug 302 (e.g., a lower central bore portion 318). As illustrated, the sealing material 236 (e.g., cement) may be pumped through the check-valve 312 into the lower central bore portion 318. Further, as illustrated, the sealing material 236 may be injected through the secondary plug 302 via the injection conveyance 238 (e.g., drill pipe, coiled tubing, or some combination thereof) to help minimize an amount of the sealing material 236 injected into the portion of the central bore 230 disposed uphole from the secondary plug 302 (e.g., an upper central bore portion 320). As set forth in greater detail below, the cutting device 246 (shown in FIG. 3E) may make the orbital cut 244 (shown in FIG. 3E) above the secondary plug 302, so maintaining the upper central bore portion 320 clear of sealing material 236 may allow the cutting device 246 to be lowered into position for making the orbital cut 244 without having to mill out the upper central bore portion 320 with the milling device 240 (shown in FIG. 2D). In some embodiments, the sealing material 236 may be pushed downhole through the secondary plug 302 via a dart (not shown) driven downhole with fluid pressure from a fluid (e.g., drilling fluid, cleaning fluid, etc.) injected into the wellbore 108. The fluid may provide fluid pressure to drive the dart while also cleaning the upper central bore portion 320 as the dart moves toward the secondary plug 302.

Moreover, the sealing material 236 may be pumped into the lower central bore portion 318 in a partially liquid state. Accordingly, as the lower central bore portion 318 is filled with the sealing material 236, fluid pressure from the sealing material 236 entering through the check-valve 312 may drive the sealing material 236 through the at least one fluid path 228 and into the annulus 220. The sealing material 236 may continue to be pumped through the check-valve 312 to drive the sealing material 236 to fill a portion of the annulus 220 proximate the packer assembly 222 and continue to flow uphole in the annulus 220 to fill the annulus 220 up to a position uphole from the secondary plug 302. That is, sealing material 236 may be pumped into the annulus 220 until the annulus 220 is at least sufficiently filled such that the sealing material 236 surrounds at least a portion of a control line 200 disposed uphole from the secondary plug 302.

Further, as set forth above, the sealing material 236 may include cement, plastic, resin, or some combination thereof. As set forth above, the sealing material 236 may be pumped into the lower central bore portion 318 and the annulus 220 in a partially liquid state. However, the sealing material 236 is configured to solidify after being injected into the annulus 220. For example, the sealing material 236 may include cement 118 that is mixed with water prior to being injected into the wellbore 108 such that the cement 118 is in a liquid or fluid state. However, due to the chemical reaction (e.g., hydration) between the water and the cement 118, the cement 118 may solidify or harden over time. Once hardened, the cement 118 disposed in the annulus 220 may restrain movement of the control line 200. Specifically, the hardened cement 118 may restrain lateral movement of at least a portion of the control line 200 disposed uphole from the secondary plug 302.

Figure 3F:
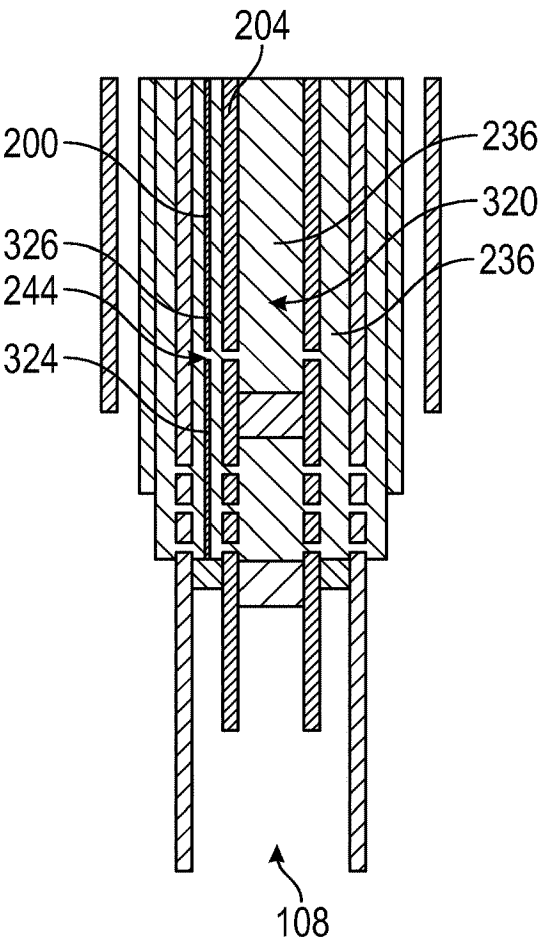
Figure 3E:
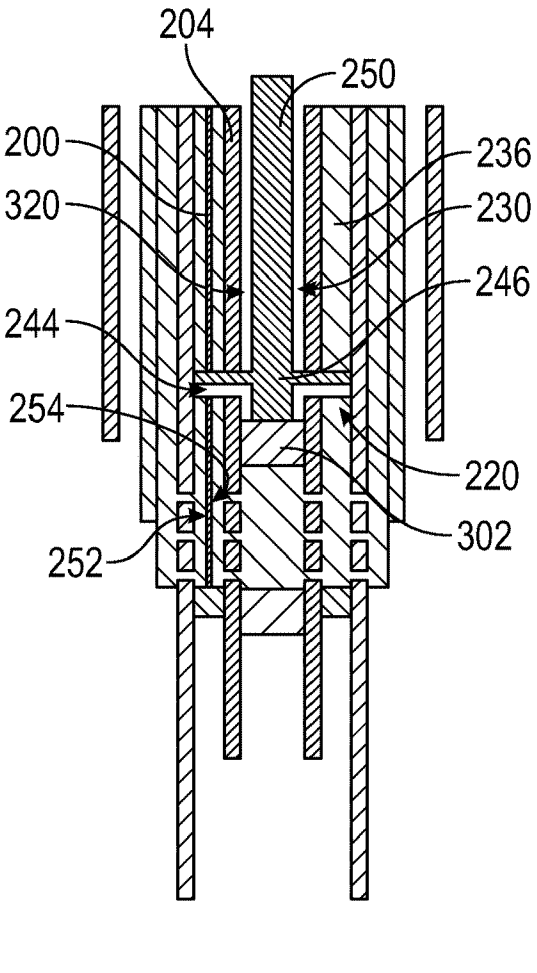
Figure 3D:
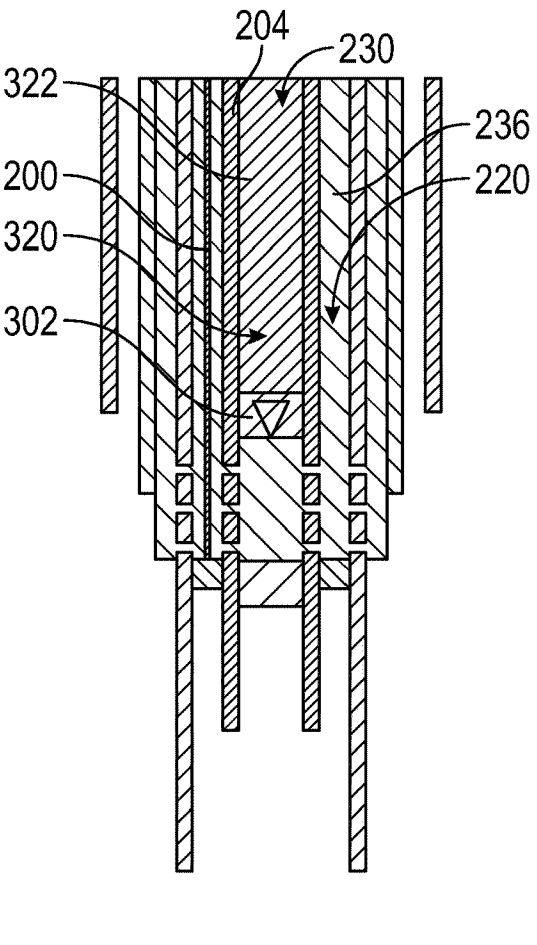

FIG. 3D discloses the injection conveyance 238 (shown in FIG. 3E) removed from the central bore 230 of the inner tubular 204. Once the annulus 220 is at least sufficiently filled with the sealing material 236 such that the sealing material 236 surrounds at least a portion of a control line 200 disposed uphole from the secondary plug 302, the injection conveyance 238 may be disconnected from the secondary plug 302 and pulled out-of-hole. Further high pressure fluid (e.g., a cleaning fluid 322) may be run into the inner tubular 204 to remove the sealing material 236 disposed uphole from the secondary plug 302. As set forth above, maintaining the upper central bore portion 320 clear of sealing material 236 may allow the cutting device 246 (shown in FIG. 3E) to be lowered into position for making the orbital cut 244 without having to mill out the upper central bore portion 320 with the milling device 240 (shown in FIG. 2D). Running the high pressure fluid into the central bore 230 of the inner tubular 204 may remove at least a portion of the sealing material 236 that may have entered the upper central bore portion 320 during connection and/or disconnection of the injection conveyance 238, as well as any sealing material 236 that may have entered the upper central bore portion 320 during injection of the sealing material 236 through the secondary plug 302.

FIG. 3E discloses the control line 200 and/or flat pack severed via making the orbital cut 244 at a position uphole the secondary plug 302. As illustrated, the cutting device 246 may be run-in-hole to a target location in the central bore 230 for making the at least one orbital cut 244 (e.g., a location that is axially aligned with a portion of the annulus 220 that is filled with the hardened sealing material 236). As set forth above, the sealing material 236 is pumped into the annulus 220 to a position that is uphole from the secondary plug 302. Further, as set forth above, the upper central bore portion 320 (e.g., the portion of the central bore 230 disposed above the secondary plug 302) may be substantially clear of sealing material 236. Accordingly, with the injection conveyance 238 pulled out-of-hole, the cutting device 246 may run-in-hole to the target location above the secondary plug 302. Indeed, the cutting device 246 may be run-in-hole to the target location above the secondary plug 302 without having to mill out the upper central bore portion 320 with the milling device 240. The cutting device 246 may be run-in-hole via a cutting device conveyance 250 (e.g., a slickline, a wireline, coiled tubing, drill pipe, etc.). Further, the cutting device 246 may include any suitable cutting device. For example, the cutting device 246 may include an abrasive jetting device, a blade cutter, a reamer, a plasma torch, or some combination thereof.

Moreover, at the target location above the secondary plug 302, the cutting device 246 may be configured to cut through the inner tubular 204 (e.g., production tubing) and the sealing material 236 in the annulus 220 and sever the control line 200 surrounded by the sealing material 236. Indeed, the hardened sealing material 236 is configured to restrain at least lateral movement of the control line 200. As set forth above, the cutting device 246 may fail to cut the control line 200 if the control line 200 is permitted to move in response to contact with the cutting device 246. However, in the illustrated embodiment, as the cutting device 246 cuts through the sealing material 236 and engages the control line 200 and/or flat pack, the remaining sealing material 236 may prevent the control line 200 and/or flat pack from moving laterally in response to contact with the cutting device 246. That is, the cutting device 246 may engage a radially inner side 252 of the control line 200 and the radially outer side 254 of the control line 200 may be in contact with the remaining hardened sealing material 236. As the cutting device 246 engages the radially inner side 252, the remaining hardened sealing material 236 may prevent the control line 200 from moving radially outward such that the cutting device 246 may engage and sever the control line 200. Further, as set forth above, should the cutting device 246 engage another side of the control line 200, an opposite side of the control line 200 may interface with the remaining hardened sealing material 236 to prevent the control line 200 from moving with respect to the cutting device 246.

FIG. 3F discloses the sealing material 236 disposed in the orbital cut 244 and the upper central bore portion 320. After making the orbital cut 244, additional sealing material 236 may be injected into the upper central bore portion 320 of the inner tubular 204 (e.g., production tubing) to fill the volume removed by making the orbital cut 244 and fill at least a portion of the upper central bore portion 320. As set forth above, control lines 200 may provide leak paths for hydrocarbons to travel through the seal formed in the wellbore 108 as part of the P&A operations. Accordingly, filling the orbital cut 244 with the additional sealing material 236 may fluidly isolate the lower portion 324 of the severed control line 200 from the upper portion 326 of the severed control line 200, which may block a leak path for hydrocarbons.

Figures 4A, 4B, 4C:
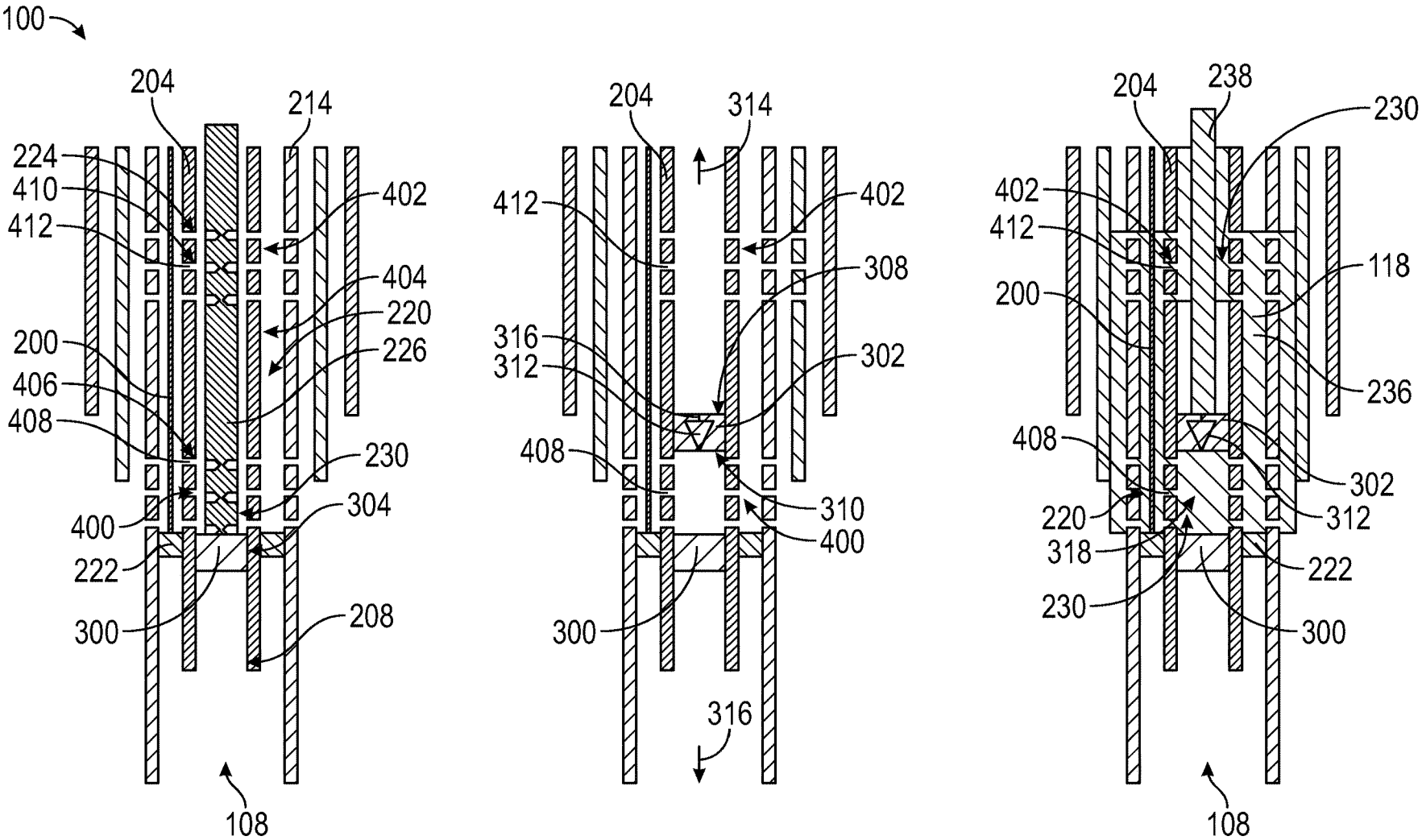
FIGS. 4A-4F illustrate respective cross-sectional views of another well abandonment system configured to sever control lines in a wellbore, in accordance with some embodiments of the present disclosure.

FIGS. 4A-4F illustrate respective cross-sectional views of another well abandonment system 100 configured to sever control lines 200 in a wellbore 108, in accordance with some embodiments of the present disclosure. FIG. 4A discloses the wellbore 108 having the primary plug 300 disposed in the inner tubular 204 to form a fluid barrier, as well as the inner tubular 204 having a plurality of perforations 224. The primary plug 300 may be run-in-hole and set at a target location in the inner tubular 204 (e.g., the production tubing) to block fluid from traveling through the inner tubular 204 at the primary plug 300. As set forth above, the primary plug 300 may include any suitable material. In the illustrated embodiment, the primary plug 300 comprises a cylindrical shape such that a radially outer surface 304 of the primary plug 300 may seal against a radially inner surface 208 of the inner tubular 204 to restrain fluid. However, the primary plug 300 may include any suitable shape for blocking fluid. Further, the primary plug 300 may be expandable. That is, the primary plug 300 may be run-in-hole to the target location and then expand at the target location to seal against the inner tubular 204.

Further, the annulus 220 may be formed between the inner tubular 204 and the production casing 214 and/or the wellbore wall 122 may be left open (e.g., not filled with sealing material 236) such that fluid may flow through the annulus 220. In the illustrated embodiment, the annulus 220 may be sealed via a packer assembly 222 or any suitable sealing feature to restrain fluid flow from the bottom of the wellbore 108 to the surface. Further, as illustrated, the primary plug 300 may be run-in-hole to a location disposed proximate the packer assembly 222. The packer assembly 222 and the primary plug 300, in combination, may provide a fluid barrier between the surface and the bottom of the wellbore 108 and/or a production zone.

Moreover, with the primary plug 300 set in the inner tubular 204, the perforating device 226 (e.g., perforating gun, blade, reamer, hydro jet, plasma torch, etc.) may be lowered into the wellbore 108 to perforate the inner tubular 204 above the primary plug 300. In particular, the perforating device 226 may be configured to perforate the inner tubular 204 to form a first perforation zone 400 and a second perforation zone 402. The first perforation zone 400 may be disposed proximate the primary plug 300. In particular, the first perforation zone 400 may be disposed immediately uphole from the primary plug 300, and the second perforation zone 402 may be disposed uphole from the first perforation zone 400. The first perforation zone 400 and the second perforation zone 402 may be spaced apart axially (i.e., axially offset). As illustrated, a non-perforated zone 404 may be disposed between the first perforation zone 400 and the second perforation zone 402 to separate the first perforation zone 400 from the second perforation zone 402. The non-perforated zone 404 may have an axial length between 50-200 meters, which may provide sufficient space for the secondary plug 302 (shown in FIG. 4B) discussed below.

Moreover, the first perforation zone 400 may include at least one first perforation 406, which opens at least one first fluid path 408 between the central bore 230 of the inner tubular 204 and the annulus 220 such that the sealing material 236 may be injected into the annulus 220 from the central bore 230 via the at least one fluid path 228. Further, as illustrated, the first perforation zone 400 may include a plurality of first perforations 406 that open a plurality of first fluid paths 408 between the central bore 230 of the inner tubular 204 and the annulus 220. The first perforation zone 400 may extend 1.0 to 10.0 meters along the inner tubular 204. Further, each first fluid path of the plurality of first fluid paths 408 in the first perforation zone 400 may be axially offset from at least one adjacent first fluid path along the inner tubular 204 by 1.0 to 30.0 centimeters. Additionally, the second perforation zone 402 may include at least one second perforation 410, which opens at least one second fluid path 412 between the central bore 230 of the inner tubular 204 and the annulus 220. Similarly, the second perforation zone 402 may include a plurality of perforations 410 that open a plurality of second fluid paths 412 between the central bore 230 of the inner tubular 204 and the annulus 220. The second perforation zone 402 may extend 1.0 to 10.0 meters along the inner tubular 204. Each second fluid path of the plurality of second fluid paths 412 in the second perforation zone may be axially offset from at least one adjacent second fluid path along the inner tubular 204 by 1.0 to 30.0 centimeters.

FIG. 4B discloses a secondary plug 302 disposed in the inner tubular 204. As illustrated, the secondary plug 302 may be run-in-hole and set in a position uphole from the primary plug 300. In particular, the secondary plug 302 may be run-in-hole and set in a position between the first perforation zone 400 and the second perforation zone 402 such that the secondary plug 302 is disposed between the at least one first fluid path 408 and the at least one second fluid path 412. Moreover, the secondary plug 302 may comprise the through bore 306 extending from the uphole end 308 to the downhole end 310 of the secondary plug 302 such that fluid may pass through the secondary plug 302. However, the secondary plug 302 may also include the check-valve 312 configured to restrain fluid flow in the uphole direction 314. The check-valve 312 may include any suitable type of check valve for restraining flow of the sealing material 236 in the uphole direction 314 and permitting fluid flow of the sealing material 236 in the downhole direction 316 through the check-valve 312. For example, the check-valve 312 may include a flapper check valve having a flapper configured to swing open in response to fluid (e.g., the sealing material 236) flowing in the downhole direction 316 and close in response to the fluid flowing in the uphole direction 314.

FIG. 4C discloses the sealing material 236 disposed in the wellbore 108. As illustrated, the sealing material 236 (e.g., cement) may be pumped through the check-valve 312 into the lower central bore portion 318 (e.g., the portion of the central bore 230 disposed between the primary plug 300 and the secondary plug 302). The sealing material 236 may be injected through the secondary plug 302 via the injection conveyance 238 (e.g., drill pipe, coiled tubing, or some combination thereof). Moreover, the sealing material 236 may be pumped into the lower central bore portion 318 in a partially liquid state. Accordingly, as the lower central bore portion 318 is filled with the sealing material 236, fluid pressure from the sealing material 236 entering through the check-valve 312 may drive the sealing material 236 through the at least one first fluid path 408 and into the annulus 220. The sealing material 236 may continue to be pumped through the check-valve 312 to drive the sealing material 236 to fill a portion of the annulus 220 proximate the packer assembly 222 and continue to flow upward in the annulus 220 to a portion of the annulus 220 adjacent the second perforation zone 402. As the sealing material 236 continues to be pumped through the check-valve 312, the sealing material 236 may flow into the central bore 230 of the inner tubular 204, above the secondary plug 302, via the at least one second fluid path 412. Moreover, as the at least one second fluid path 412 is disposed above the secondary plug 302, the sealing material 236 pumped into and through the annulus may surround at least a portion of a control line 200 disposed uphole from the secondary plug 302.

In some embodiments, an upper end of the annulus 220 may be sealed. For example, the wellbore 108 may be formed as part of an underwater drilling operation such that the upper end of the annulus 220 may be sealed. As such, the at least one second fluid path 412 may allow the sealing material 236 to flow into and through the annulus 220 without causing a significant pressure increases in the annulus 220 (i.e., significant pressure increases in the annulus may rupture the tubulars). That is, the at least one second fluid path 412 may provide a pressure outlet for the annulus 220.

Further, as set forth above, the sealing material 236 may include cement, plastic, resin, or some combination thereof. As set forth above, the sealing material 236 may be pumped into the lower central bore portion 318 and the annulus 220 in a partially liquid state. However, the sealing material 236 is configured to solidify after being injected into the annulus 220. For example, the sealing material 236 may include cement 118 that is mixed with water prior to being injected into the wellbore 108 such that the cement 118 is in a liquid or fluid state. However, due to the chemical reaction (e.g., hydration) between the water and the cement 118, the cement 118 may solidify or harden over time. Once hardened, the cement 118 disposed in the annulus 220 may restrain movement of the control line 200. Specifically, the hardened cement 118 may restrain lateral movement of at least a portion of the control line 200 disposed uphole from the secondary plug 302. However, as set forth in greater detail below, the injection conveyance 238 should be removed before the sealing material 236 hardens to prevent the sealing material 236 in the central bore 230 above the secondary plug 302 from trapping the injection conveyance 238 in the wellbore 108.

Figure 4F:
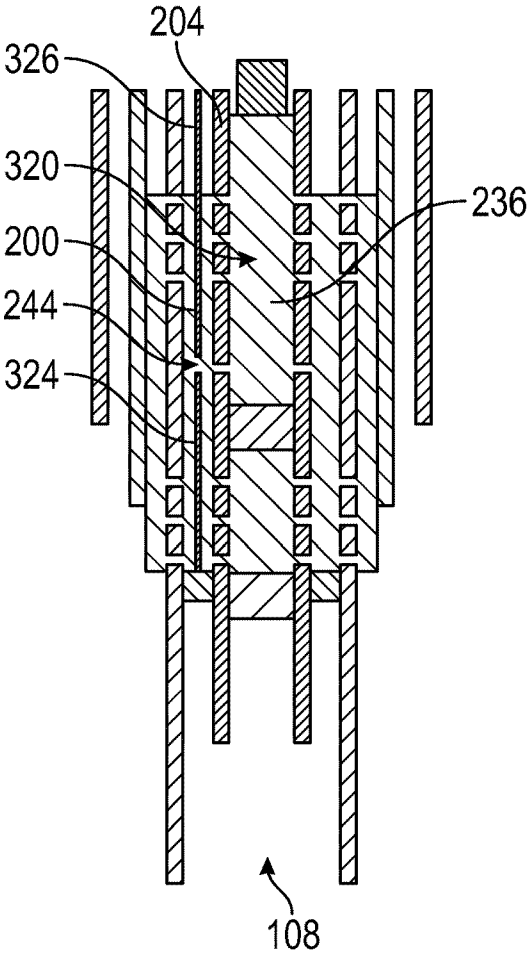
Figure 4E:
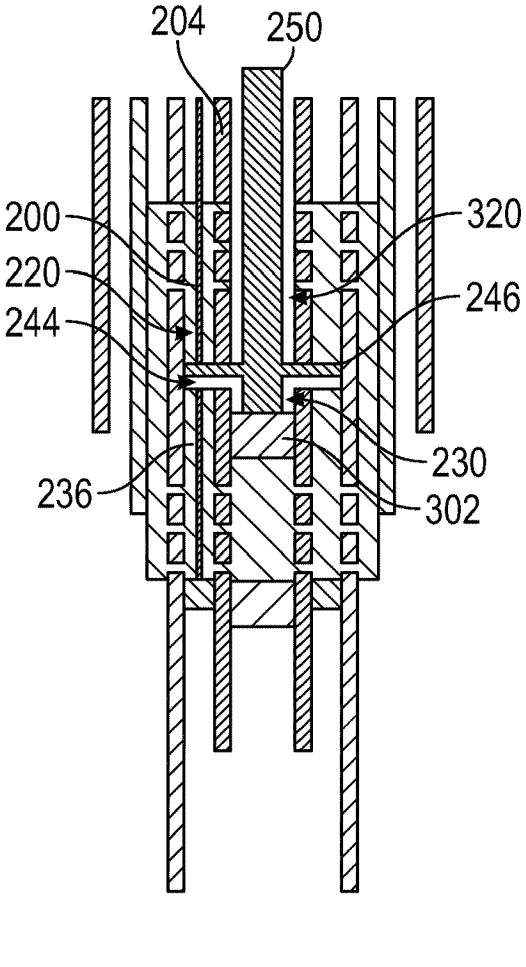
Figure 4D:
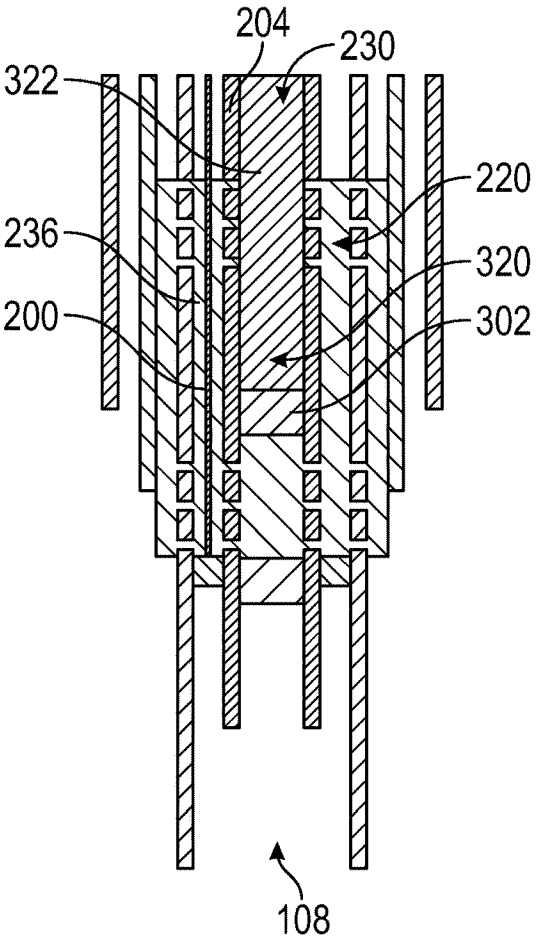

FIG. 4D discloses the injection conveyance 238 (shown in FIG. 4C) removed from the central bore 230 of the inner tubular 204. Once the annulus 220 is at least sufficiently filled with the sealing material 236 such that the sealing material 236 surrounds at least a portion of the control line 200 disposed uphole from the secondary plug 302, the injection conveyance 238 may be disconnected from the secondary plug 302 and pulled out-of-hole through the sealing material 236 disposed in the central bore 230 above the secondary plug 302. As such, the injection conveyance 238 must be removed before the sealing material 236 sets and is still in an at least partially liquid state. Further, prior to the sealing material 236 setting, high pressure fluid (e.g., cleaning fluid 322) may be run into the inner tubular 204 to remove the sealing material 236 disposed uphole from the secondary plug 302. As set forth above, maintaining the upper central bore portion 320 clear of sealing material 236 may allow the cutting device 246 (shown in FIG. 4D) to be lowered into position for making the orbital cut 244 (shown in FIG. 4D) without having to mill out the upper central bore portion 320. Running the high pressure fluid (e.g., the cleaning fluid 322) into the central bore 230 of the inner tubular 204 may remove at least a portion of the sealing material 236 that may have entered the upper central bore portion 320 during injection of the sealing material 236 into the wellbore 108.

FIG. 4E discloses the control line 200 and/or flat pack severed via making the orbital cut 244 at a position uphole the secondary plug 302. As illustrated, the cutting device 246 may be run-in-hole to a target location in the central bore 230 for making the at least one orbital cut 244 (e.g., a location that is axially aligned with a portion of the annulus 220 that is filled with the hardened sealing material 236). As set forth above, the sealing material 236 is pumped into the annulus 220 to a position that is uphole from the secondary plug 302. Further, as set forth above, the upper central bore portion 320 (e.g., the portion of the central bore 230 disposed above the secondary plug 302) may be substantially clear of sealing material 236. Accordingly, once the injection conveyance 238 is pulled out-of-hole and the upper central bore portion 320 is cleaned, the cutting device 246 may run-in-hole to the target location above the secondary plug 302 without having to mill out the upper central bore portion 320. The cutting device 246 may be run-in-hole via a cutting device conveyance 250 (e.g., a slickline, a wireline, coiled tubing, drill pipe, etc.). Further, the cutting device 246 may include any suitable cutting device. For example, the cutting device 246 may include an abrasive jetting device, a blade cutter, a reamer, a plasma torch, or some combination thereof.

Moreover, at the target location above the secondary plug 302, the cutting device 246 may be configured to cut through the inner tubular 204 (e.g., production tubing) and the sealing material 236 in the annulus 220 and sever the control line 200 surrounded by the sealing material 236. Indeed, the hardened sealing material 236 is configured to restrain at least lateral movement of the control line 200. As set forth above, the cutting device 246 may fail to cut the control line 200 if the control line is permitted to move in response to contact with the cutting device 246. However, in the illustrated embodiment, as the cutting device 246 cuts through the sealing material 236 and engages the control line 200 and/or flat pack, the remaining sealing material 236 may prevent the control line 200 and/or flat pack from moving laterally in response to contact with the cutting device 246. That is, as the cutting device 246 engages a first side of the control line 200, an opposite side of the control line 200 may interface with the remaining hardened sealing material 236 to prevent the control line 200 from moving with respect to the cutting device 246 such that the cutting device 246 may engage and sever the control line 200.

FIG. 4F discloses the sealing material 236 disposed in the orbital cut 244 and the upper central bore portion 320. After making the orbital cut 244, additional sealing material 236 may be injected into the upper central bore portion 320 of the inner tubular 204 (e.g., production tubing) to fill the volume removed by making the orbital cut 244 and fill at least a portion of the upper central bore portion 320. As set forth above, the control lines 200 may provide leak paths for hydrocarbons to travel through a seal formed in the wellbore 108 as part of the P&A operations. Accordingly, filling the orbital cut 244 with the additional sealing material 236 may fluidly isolate the lower portion 324 of the severed control line 200 from the upper portion 326 of the severed control line 200, which may block a leak path for hydrocarbons.

Accordingly, the present disclosure may systems and methods for severing control lines and/or flat packs during plug and abandonment (P&A) operations. The systems and methods may include any of the various features disclosed herein, including one or more of the following statements.

Statement 1. A method, comprising: injecting a sealing material into an annulus formed between a tubular and a wellbore wall, wherein the sealing material is configured to surround at least a portion of a control line disposed in the annulus; making at least one orbital cut, via a cutting device, through the tubular, the sealing material in the annulus, and the control line surrounded by the sealing material; and filling the at least one orbital cut and at least a portion of a central bore of the tubular with the sealing material to seal a wellbore.

Statement 2. The system of statement 1, wherein the cutting device comprises an abrasive jetting device, a blade cutter, a reamer, a plasma torch, or some combination thereof.

Statement 3. The system of any preceding statement, further comprising running a plug into a wellbore, via a plug conveyance, to a sealing position in a tubular disposed in the wellbore, wherein the plug conveyance comprises a slickline, a wireline, coiled tubing, drill pipe, or some combination thereof.

Statement 4. The system of any preceding statement, further comprising perforating a tubular above a plug disposed in a wellbore, via a perforating device, to open at least one fluid path between the central bore of the tubular and the annulus formed between the tubular and the wellbore wall.

Statement 5. The system of any preceding statement, wherein the perforating device comprises a perforating gun having shaped charges configured to detonate in a substantially radially outward direction to perforate the tubular above the plug disposed in the wellbore.

Statement 6. The system of statements 1-4, wherein the perforating device comprises the cutting device, and wherein the cutting device is configured to perforate the tubular above the plug disposed in the wellbore.

Statement 7. The system of any preceding statement, wherein the sealing material is injected into the annulus from the central bore of the tubular via the at least one fluid path extending from the central bore of the tubular to the annulus.

Statement 8. The system of any preceding statement, wherein the sealing material is injected into the annulus in at least a partially liquid state, and wherein the sealing material is configured to solidify in the annulus to restrain lateral movement of the control line.

Statement 9. The system of any preceding statement, wherein the sealing material comprises cement, plastic, resin, or some combination thereof.

Statement 10. The system of any preceding statement, further comprising milling out at least a portion of the sealing material in the central bore of the tubular, via a milling device, before making the at least one orbital cut.

Statement 11. The system of any preceding statement, wherein the milling device is run-in-hole via a drilling bit conveyance, wherein the milling device conveyance comprises a drill pipe, coiled tubing, or some combination thereof, and wherein a mud motor is configured to drive rotation of the milling device during operation.

Statement 12. The system of any preceding statement, wherein the cutting device is run-in-hole to a milled out portion of the central bore of the tubular to make the at least one orbital cut.

Statement 13. The system of any preceding statement, wherein the cutting device is run-in-hole via a cutting device conveyance, wherein the cutting device conveyance comprises a slickline, a wireline, coiled tubing, drill pipe, or some combination thereof.

Statement 14. A method, comprising: running a primary plug into a wellbore to a sealing position in a tubular disposed in the wellbore; perforating the tubular above the primary plug, via a perforating gun, to open at least one fluid path between a central bore of the tubular and an annulus formed between the tubular and a wellbore wall; running a secondary plug into the wellbore to a position above the at least one fluid path; injecting cement through the secondary plug and into the annulus via the at least one fluid path from the central bore of the tubular, wherein the cement is configured flow into the annulus to a position uphole from the secondary plug in the central bore to surround at least a portion of a control line disposed uphole from the secondary plug; making at least one orbital cut at a position uphole the secondary plug, via a cutting device, through the tubular, the cement in the annulus, and the control line surrounded by the cement; and injecting cement into the wellbore to fill areas removed by the cutting device to seal the wellbore.

Statement 15. The system of statement 14, wherein the secondary plug comprises a check-valve configured to restrain fluid flow in an uphole direction.

Statement 16. The system of statement 14 or statement 15, wherein the cement is pushed downhole through the secondary plug via a dart driven downhole with fluid pressure from a cleaning fluid.

Statement 17. The system of statement 14 or statement 15, wherein the cement is injected through the secondary plug via an injection conveyance, wherein the injection conveyance comprises drill pipe, coiled tubing, or some combination thereof.

Statement 18. The system of statements 14-17, further comprising pulling the injection conveyance out-of-hole and running high pressure fluid into the tubular to remove the cement disposed uphole from the secondary plug.

Statement 19. A method, comprising: running a primary plug into a wellbore to a sealing position in a tubular disposed in the wellbore; perforating the tubular above the primary plug, via a perforating gun, to open a first fluid path and a second fluid path each extending between a central bore of the tubular and an annulus formed between the tubular and a wellbore wall, wherein the first fluid path and the second fluid path are axially offset from each other along the wellbore; running a secondary plug into the wellbore to a position between the first fluid path and the second fluid path; injecting cement, via a conveyance, through the secondary plug and into the annulus via the first fluid path from the central bore of the tubular, wherein the cement is configured flow into the annulus to a position uphole from the secondary plug in the central bore to surround at least a portion of a control line disposed uphole from the secondary plug, and wherein a portion of the cement is configured to flow from the annulus into the central bore via the second fluid path; removing the conveyance from the wellbore; circulating fluid in the central bore to remove the cement disposed in the central bore above the secondary plug; making at least one orbital cut at a position uphole the secondary plug, via a cutting device, through the tubular, the cement in the annulus, and the control line surrounded by the cement; and injecting cement into the wellbore to fill areas removed by the cutting device to seal the wellbore.

Statement 20. The system of statement 19, wherein the perforating gun is configured to perforate the tubular to form a first perforation zone comprising the first fluid path and to form a second perforation zone comprising the second fluid path, and wherein a non-perforated zone is disposed between the first perforation zone and the second perforation zone.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method, comprising:

perforating a tubular above a plug disposed in the tubular, via a perforating device, to open at least one fluid between a central bore of the tubular and an annulus formed between the tubular and a wellbore wall of a wellbore, wherein the plug is configured to block fluid flow through the tubular;

injecting a sealing material into the central bore of the tubular and into the annulus formed between the tubular and the wellbore wall via the sealing material flowing through the at least one fluid path from the central bore, wherein the sealing material is configured to surround at least a portion of a control line disposed in the annulus, and wherein the sealing material is configured to fill the central bore to a same height or higher than the annulus;

milling out at least a portion of the sealing material disposed in the central bore above the plug, via a milling device, to a height lower than the sealing material in the annulus;

lowering a cutting device into a milled out portion of the central bore to position that is axially aligned with a portion of the annulus having the sealing material;

making at least one orbital cut, via the cutting device, through the tubular, the sealing material in the annulus, and the control line surrounded by the sealing material; and filling the at least one orbital cut and at least a portion of the central bore of the tubular with the sealing material to seal the wellbore.

2. The method of claim 1, wherein the cutting device comprises an abrasive jetting device, a blade cutter, a reamer, a plasma torch, or some combination thereof.

3. The method of claim 1, further comprising running the plug into the wellbore, via a plug conveyance, to a sealing position in the central bore of the tubular disposed in the wellbore, wherein the plug conveyance comprises a slickline, a wireline, coiled tubing, drill pipe, or some combination thereof.

4. The method of claim 1, wherein the perforating device comprises a perforating gun having shaped charges configured to detonate in a substantially radially outward direction to perforate the tubular above the plug disposed in the wellbore.

5. The method of claim 1, wherein the perforating device comprises the cutting device, and wherein the cutting device is configured to perforate the tubular above the plug disposed in the wellbore.

6. The method of claim 1, wherein the sealing material is injected into the annulus in at least a partially liquid state, and wherein the sealing material is configured to solidify in the annulus to restrain lateral movement of the control line.

7. The method of claim 1, wherein the sealing material comprises cement, plastic, resin, or some combination thereof.

8. The method of claim 1, wherein the milling device is run-in-hole via a drilling bit conveyance, wherein the milling device conveyance comprises a drill pipe, coiled tubing, or some combination thereof, and wherein a mud motor is configured to drive rotation of the milling device during operation.

9. The method of claim 1, wherein the cutting device is run-in-hole via a cutting device conveyance, wherein the cutting device conveyance comprises a slickline, a wireline, coiled tubing, drill pipe, or some combination thereof.

10. The method of claim 1, further comprising injecting cleaning fluid into the central bore of the tubular to clean the central bore, the annulus, or some combination thereof, after perforating the tubular.

* * * * *